US008766126B2

(12) United States Patent
Kawaguchi et al.

(10) Patent No.: US 8,766,126 B2
(45) Date of Patent: Jul. 1, 2014

(54) OPERATION SWITCH

(75) Inventors: Kenichi Kawaguchi, Nishiwaki (JP); Masazumi Taniguchi, Sakai (JP); Atsushi Matsumoto, Izumi (JP); Masashi Fujimoto, Neyagawa (JP); Yasuo Onishi, Akashi (JP)

(73) Assignee: IDEC Corporation, Yodogawa-ku (JP)

( * ) Notice: Subject to any disclaimer, the term of this patent is extended or adjusted under 35 U.S.C. 154(b) by 104 days.

(21) Appl. No.: 13/510,081

(22) PCT Filed: Nov. 8, 2010

(86) PCT No.: PCT/JP2010/070250

§ 371 (c)(1),
(2), (4) Date: May 16, 2012

(87) PCT Pub. No.: WO2011/062124

PCT Pub. Date: May 26, 2011

(65) Prior Publication Data

US 2012/0228108 A1 Sep. 13, 2012

(30) Foreign Application Priority Data

Nov. 20, 2009 (JP) ..... 2009-265042

(51) Int. Cl.

| | |
|---|---|
| ***H01H 1/26*** | (2006.01) |
| ***H01H 13/20*** | (2006.01) |
| ***H01H 5/18*** | (2006.01) |
| ***H01H 13/36*** | (2006.01) |
| ***H01H 13/02*** | (2006.01) |
| ***H01H 13/62*** | (2006.01) |

(52) U.S. Cl.

CPC ..... *H01H 13/20* (2013.01); *H01H 5/18* (2013.01); *H01H 13/36* (2013.01); *H01H 13/02* (2013.01); *H01H 13/62* (2013.01)

USPC ..... 200/535; 200/283; 200/16 B

(58) Field of Classification Search

CPC ..... H01H 13/12; H01H 13/02; H01H 13/20; H01H 13/80; H01H 1/26; H01H 3/022; H01H 13/42; H01H 13/36; H01H 13/38; H01H 13/46; H01H 13/62; H01H 5/18

USPC ..... 200/535, 530, 283, 16 B, 16 D

See application file for complete search history.

(56) References Cited

U.S. PATENT DOCUMENTS

| | | | | |
|---|---|---|---|---|
| 5,017,747 | A * | 5/1991 | Nagahara et al. | 200/453 |
| 6,096,990 | A * | 8/2000 | Marin | 200/535 |

(Continued)

FOREIGN PATENT DOCUMENTS

| | | |
|---|---|---|
| JP | 51-006662 | 2/1976 |
| JP | 59-057817 | 4/1984 |
| JP | 2003-303527 | 10/2003 |

OTHER PUBLICATIONS

International Search Report of the International Searching Authority for International Application PCT/JP2010/070250, mailed Mar. 1, 2011, 3 pages, Japanese Patent Office.

(Continued)

*Primary Examiner* — Kyung Lee
(74) *Attorney, Agent, or Firm* — W. F. Fasse

(57) ABSTRACT

A push button switch 1 is so constructed as to disengage the movable contacts 55*b*, 56*b* from the fixed contacts 55*a*, 56*a* through operation of the push button 2 held in the switch case 3. A first leaf spring 550 is provided in the switch case 3 to act as an opening-biasing means to bias the movable contacts 55*b*, 56*b* away from the fixed contacts 55*a*, 56*a*. The movable contact 55*b* is disposed at an end of the first leaf spring 550 and adapted to engage with and disengage from the fixed contact 55*a*. The first leaf spring 550 is adapted to be at a position where the movable contact 55*b* is open relative to and disengaged from the fixed contact 55*a* at zero displacement of the first leaf spring 550.

20 Claims, 12 Drawing Sheets

(56) References Cited

U.S. PATENT DOCUMENTS

| | | | | |
|---|---|---|---|---|
| 6,326,572 | B1 * | 12/2001 | Yu | 200/524 |
| 6,717,078 | B2 * | 4/2004 | Yoshida et al. | 200/61.53 |
| 7,081,593 | B2 * | 7/2006 | Hopkins | 200/402 |
| 2004/0069606 | A1 * | 4/2004 | Lee | 200/402 |

OTHER PUBLICATIONS

English Translation of PCT Written Opinion of the International Searching Authority for International Application PCT/JP2010/070250, mailed Mar. 1, 2011, 6 pages, Japanese Patent Office.

* cited by examiner

OPERATION SWITCH

TECHNICAL FIELD

The present invention relates generally to an operation switch such as a push button switch and the like, and more particularly to improvements in operation switches for decreasing manufacturing and assembly costs by reducing the number of components thereof.

BACKGROUND ART

Generally, in a control panel for mechanical equipment such as machine tools and the like, a push-button-type emergency stop switch is provided to emergency-stop mechanical equipment at the time of abnormal circumstances. In such a push-button-type switch, for example, Japanese patent application laying-open publication No. 2003-303527 (hereinafter referred to JP '527) discloses a switch equipped with a "safety-Potentials® structure", which is a registered trademark of IDEC Corporation, such that contacts of the switch will not return to a contact state in the event that the switch is damaged.

As shown in FIGS. 1 and 2 of JP '527, the button housing 9 receiving the push button 5 includes the compression spring 55 that biases the cylindrical member 45 at the bottom of the push button 5 toward the switch case 3 in the downward direction and the compression spring 31 that is provided at the bottom of the interlocking member 23 coupled to the bottom of the cylindrical member 45 and that biases the interlocking member 23 below the switch case 3 in the downward direction.

In this case, due to resiliently repellent force of the compressive spring 55, the interlocking member 23 is biased downwardly via the cylindrical member 45, and due to resiliently repellent force of the compressive spring 31, the interlocking member 23 is biased downward. Thereby, the movable contact 21 is biased toward the side that the movable contact 21 opens relative to the fixed contact 17.

Through operation of the push button 5, as the movable contact 21 moves away from and opens relative to the fixed contact 17, the amount of deformation of respective compression springs 55, 31 decreases, and elastic energy of respective compression springs 55, 31 thus decreases. That is, elastic energy of respective compression springs 55, 31 after opening of the contacts is smaller than elastic energy of respective compression springs 55, 31 before opening of the contacts.

Therefore, according to the push-button-type switch shown in JP '527, even in the event that the switch is damaged, the contacts will not return to the contact state again thereby displaying "safety-Potentials® function" as a push button switch.

However, in the abovementioned structure of prior art, there needs to be provided a spring discretely from the contacts that biases the movable contact away from the fixed contact, and as a result it is disadvantageous that the number of components increases and thus a manufacturing and assembly cost increases.

The present invention has been made in view of these circumstances and its object is to provide an operation switch that can decrease the number of components to reduce a manufacturing and assembly cost.

DISCLOSURE OF INVENTION

An operation switch according to the present invention includes a switch case, an operating member provided at the switch case, and a first contact and a second contact held in the switch case. Through operation of the operating member, the first contact and the second contact are made out of contact. An opening-biasing means is provided in the switch case that biases the first and second contacts in contact away from each other. The opening-biasing means is formed of a leaf spring having the first contact and the second contact.

According to the present invention, since the leaf spring as the opening-biasing means is provided with a first contact and a second contact in the switch case at a portion of the leaf spring, there is no need to provide a spring as the opening-biasing means discretely from the contacts and the leaf spring in itself comes to function as a conductive plate with a contact. Thereby, the number of components of the push button switch can be reduced and a manufacturing and assembly cost can be decreased.

In the operation switch, one of the first contact and the second contact may be a fixed contact secured in the switch case and the other of the first contact and the second contact may be a movable contact fitted at an end of the leaf spring and closable and openable relative to the fixed contact.

In this case, the movable contact at an end of the leaf spring is biased to open relative to the fixed contact due to resiliently repellent force of the leaf spring. Also, in this case, contacts with a single-break structure can be achieved thus decreasing the number of contacts.

In the operation switch, the leaf spring may be provided such that the movable contact is located at a position spaced away and disengaged from the fixed contact when displacement of the leaf spring is zero.

The operation switch may further include a slider in the switch case. The slider may be slidable in conjunction with action of the operating member. The slider may include a first contacting portion that is disposed on one side of the leaf spring and that comes into contact with the leaf spring to cause the movable contact to contact the fixed contact and a second contacting portion that is disposed on the other side of the leaf spring and that comes into contact with the leaf spring to cause the movable contact to open relative to and move away from the fixed contact.

In this case, due to contact of the first contacting portion of the slider with the leaf spring, the movable contact comes into contact with the fixed contact thus maintaining a contact state of the contacts, and also, due to contact of the second contacting portion of the slider with the leaf spring, the movable contact moves away from the fixed contact thus maintaining a non-contact state of the contacts.

In the operation switch, the leaf spring may be composed of a first leaf spring of a general L-shape and a second leaf spring of a general U-shape. The first leaf spring may have a movable contact at one end and a bent portion at an intermediate position between one end and the other end of the first leaf spring. The second leaf spring may have one end coupled to a position opposite the movable contact of the first leaf spring and a bent portion at an intermediate position between one end and the other end of the second leaf spring. A contacting portion may be provided at a position corresponding to the other end of the second leaf spring in the switch case, the contacting portion being adapted to come into contact with the second leaf spring to cause the movable contact to press-contact the fixed contact.

In this case, due to contact of the contacting portion in the switch case with the other end of the second leaf spring, the movable contact of the first leaf spring presses against the fixed contact thus maintaining the contacting state of the contacts. Also, in this case, since the biasing means of the movable contact is composed of two kinds of leaf springs, stress imparted to the spring at the time of displacement of the spring can be dispersed compared with the case that the biasing means is composed of a single leaf spring. In such a way, stress exerted to each of the leaf springs can be mitigated. Moreover, in this case, by properly predetermining rigidity (or rate) of each of the leaf springs, opening timing of the movable contact can be adjusted.

In the operation switch, the first leaf spring and the second leaf spring may be adapted to be located at a position in which the movable contact is open relative to and away from the fixed contact when respective displacements of the first leaf spring and the second leaf spring are zero.

In the operation switch, at least one of the respective bent portions of the first leaf spring and the second leaf spring may be formed of an arc-shaped portion that bulges outwardly from a corner of a general L-shape or a bend of a general U-shape.

In this case, by properly predetermining radius of curvature of the arc-shaped portion, rigidity (or rate) of the first and second leaf springs can be adjusted.

In the operation switch, the respective bent portions of the first leaf spring and the second leaf spring may be each formed of an arc-shaped portion that bulges outwardly from a corner of a general L-shape and a bend of a general U-shape. Radius of curvature of the arc-shaped portion of the first leaf spring may be different from radius of curvature of the arc-shaped portion of the second leaf spring.

For example, in the event that radius of curvature of the arc-shaped portion of the first leaf spring is greater than radius of curvature of the arc-shaped portion of the second leaf spring, bending rigidity of the arc-shaped portion of the first leaf spring is smaller than bending rigidity of the arc-shaped portion of the second leaf spring and the arc-shaped portion of the first leaf spring is thus easier to be bending-deformed than the arc-shaped portion of the second leaf spring. In this case, when the contacting portion in the switch case has come into contact with the other end of the second leaf spring, the first leaf spring is easier to deform than the second leaf spring. Thereby, opening timing of the contacts can be adjusted.

In contrast, in the event that radius of curvature of the arc-shaped portion of the second leaf spring is greater than radius of curvature of the arc-shaped portion of the first leaf spring, bending rigidity of the arc-shaped portion of the second leaf spring is smaller than bending rigidity of the arc-shaped portion of the first leaf spring and the arc-shaped portion of the second leaf spring is thus easier to be bending-deformed than the arc-shaped portion of the first leaf spring. In this case, when the contacting portion in the switch case has come into contact with the other end of the second leaf spring, the second leaf spring is easier to deform than the first leaf spring. Thereby, opening timing of the contacts can be adjusted.

As above-mentioned, according to the operation switch of the present invention, since the first and second contacts are provided in the switch case at a portion of a leaf spring as a contact-opening-biasing means, there is no need to provide a spring as an opening-biasing means discretely from a contact and also the leaf spring in itself comes to function as a conductive plate with a contact. Thereby, the number components can be reduced and a manufacturing and assembly cost can be decreased.

BEST MODE FOR CARRYING OUT THE INVENTION

Embodiments of the present invention will be hereinafter described in accordance with the appended drawings.

FIGS. 1 to 9 illustrate a push button switch for emergency stop as an operation switch according to an embodiment of the present invention.

Figure 1A:
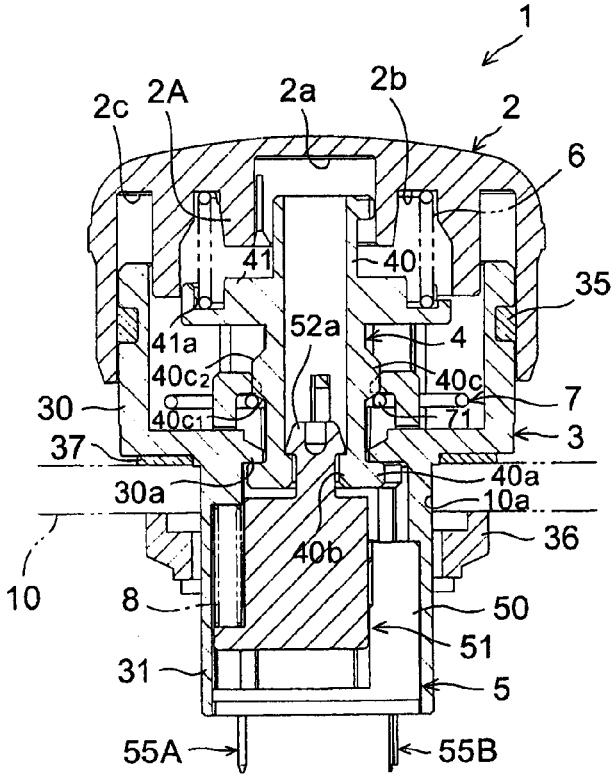
FIG. 1A is a longitudinal sectional view of a push button switch at an initial position along the longitudinal centerline according to an embodiment of the present invention.
Figure 1B:
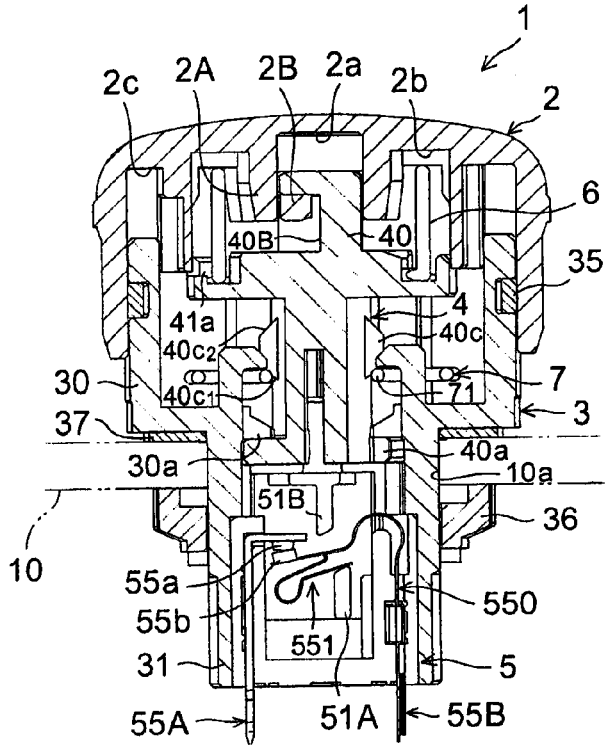
FIG. 1B is a longitudinal sectional view of the push button switch of FIG. 1A taken along the longitudinal line passing through the contacts thereof.
Figure 8:
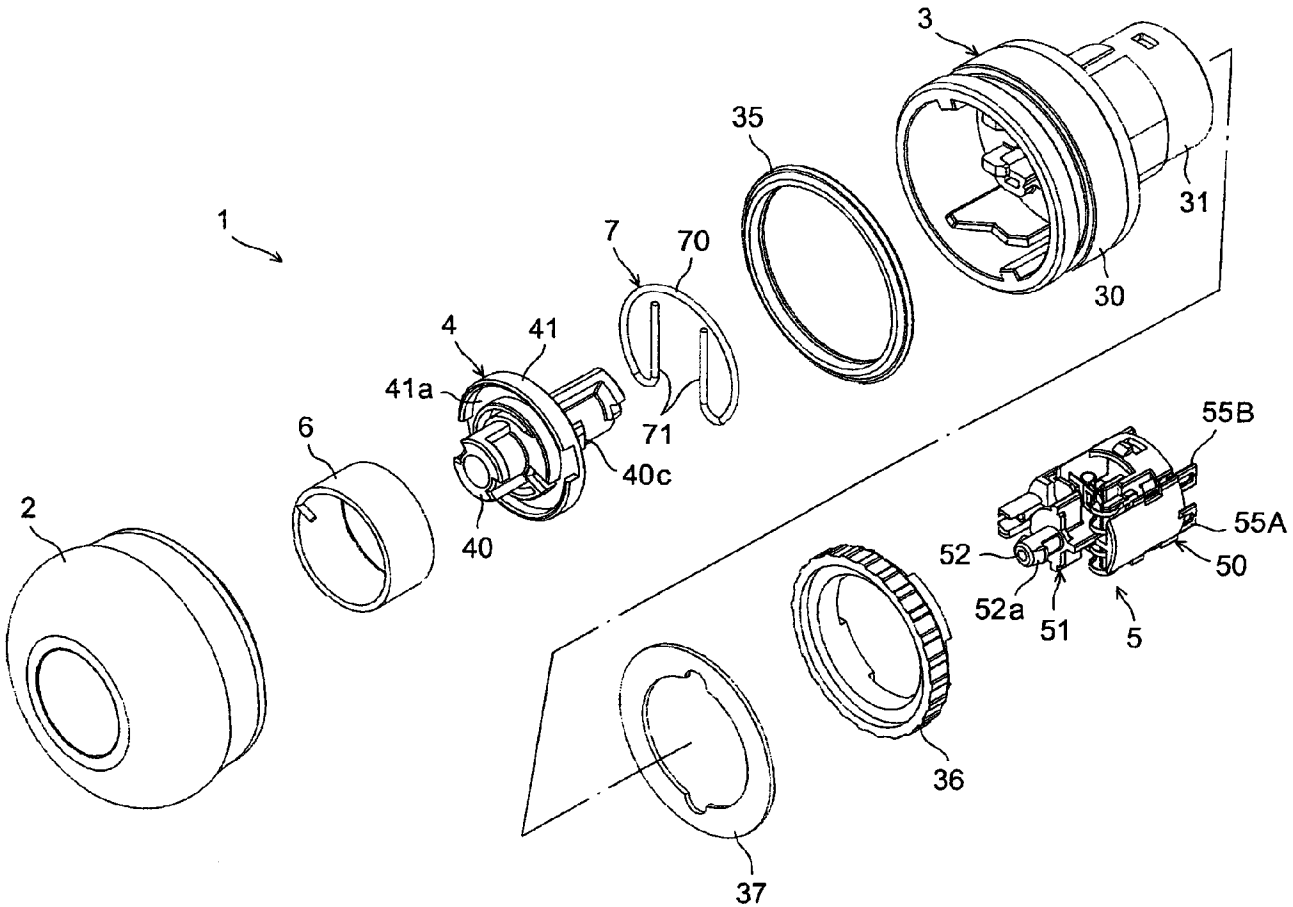
FIG. 8 is an exploded perspective view of a push button switch according to an embodiment of the present invention.

As shown in FIGS. 1A, 1B and 8, a push button switch 1 includes a push button 2 as an operating element for an operator to operate, a switch case 3 to hold the push button 2, an operating spindle 4 held in the switch case 3 and adapted to enter the inside of the switch case 3 in association with a press of the push button 2, and a contact unit 5 held in the switch case 3 and engaged with a distal end of the operating spindle 4.

The push button 2 is a cuplike member having a central hole 2*a* formed therein and annular grooves 2*b*, 2*c* formed around the central hole 2*a*. Between the central hole 2*a* and the annular grooves 2*b*, an annular protrusion 2A is formed. The central hole 2*a* has an engaging projection 2B at a part thereof. The switch case 3 is a cylindrical stepped member with openings at opposite ends thereof. The switch case 3 includes a large cylindrical portion 30 of a larger diameter which is inserted into the annular groove 2*c* of the push button 2, and a small cylindrical portion 31 of a smaller diameter smaller than the cylindrical portion 30, the cylindrical portion 31 being formed integrally with the cylindrical portion 30. The cylindrical portion 30 has a projection 30*a* projecting radially inwardly formed therein. On an outer circumferential surface of the cylindrical portion 30, a waterproof packing 35 is fitted in order to prevent water from entering the inside of the push button 2. A part of the outer circumferential surface of the cylindrical portion 31 has an external thread (not shown) formed thereon and a lock nut 36 is screwing engagement with the external thread. A gasket 37 is fitted to a stepped surface of the cylindrical portion 30.

When installing the push button switch 1 to a control panel 10 of a machine tool or the like, first, the cylindrical portion 31 of the switch case 3 is inserted into a mounting through hole 10*a* formed into the control panel 10, and then the lock nut 36 is screwed onto the cylindrical portion 31 from the inside of the control panel 10 to sandwich the control panel 10 between the lock nut 36 and the gasket 37.

The operating spindle 4 includes a hollow spindle portion 40 extending axially and a flange portion 41 projecting radially outwardly from the spindle portion 40 at a generally central position thereof. An end of the spindle portion 40 is inserted into the central hole 2*a* of the push button 2. Also, the end of the spindle portion 40 has a radially extending recess 40B formed therein. The engaging projection 2B of the push button 2 is engaged with the recess 40B. The other end of the spindle portion 40 is formed with a radially outwardly projecting projection 40*a* and a radially inwardly projecting projection 40*b*. The projection 40*a* is engaged with the projection 30*a* of the cylindrical portion 30 of the switch case 3 at an initial position shown in FIGS. 1A and 1B. At a generally central position of the spindle portion 40, there are formed a pair of bulges 40*c* which respectively extend radially outwardly. The bulges 40*c* may be placed at equal circumferential spacing from each other. A pair of slopes $\mathbf{40}c_1$, $\mathbf{40}c_2$ are formed at opposite ends of each of the bulges 40*c*. The flange portion 41 is formed with an annular groove 41*a* disposed opposite the annular groove 2*b* of the push button 2. These annular grooves 2*b*, 41*a* have a coil spring 6 fitted therein.

Inside the cylindrical portion 30 of the switch case 3, a trigger spring 7 is provided. As shown in FIG. 8, the trigger spring 7 is formed of an annular portion 70 with an opening, and a pair of hook portions 71 of a hook-shape which extend inwardly in parallel from opposite ends of the opening of the annular portion 70. The hook portions 71 are respectively in contact with the corresponding slopes $\mathbf{40}c_1$ of the bulges 40*c* of the operating spindle 4 from below at the initial position shown in FIGS. 1A and 1B.

The contact unit 5 includes a cylindrical base 50 fixedly attached to the inside of the cylindrical portion 31 of the switch case 3, and a slider 51 slidably supported in the axial direction in the base 50. An end of the slider 51 has an axial portion 52 formed thereon and a distal end of the axial portion 52 is formed with a protrusion 52*a* protruding radially outwardly. The protrusion 52*a* is engaged with the projection 40*b* of the spindle portion 40 of the operating spindle 4 at the initial position shown in FIGS. 1A and 1B. Thereby, the slider 51 is adapted to slide axially in the switch case 3 in conjunction with operation of the push button 2.

Figure 9:
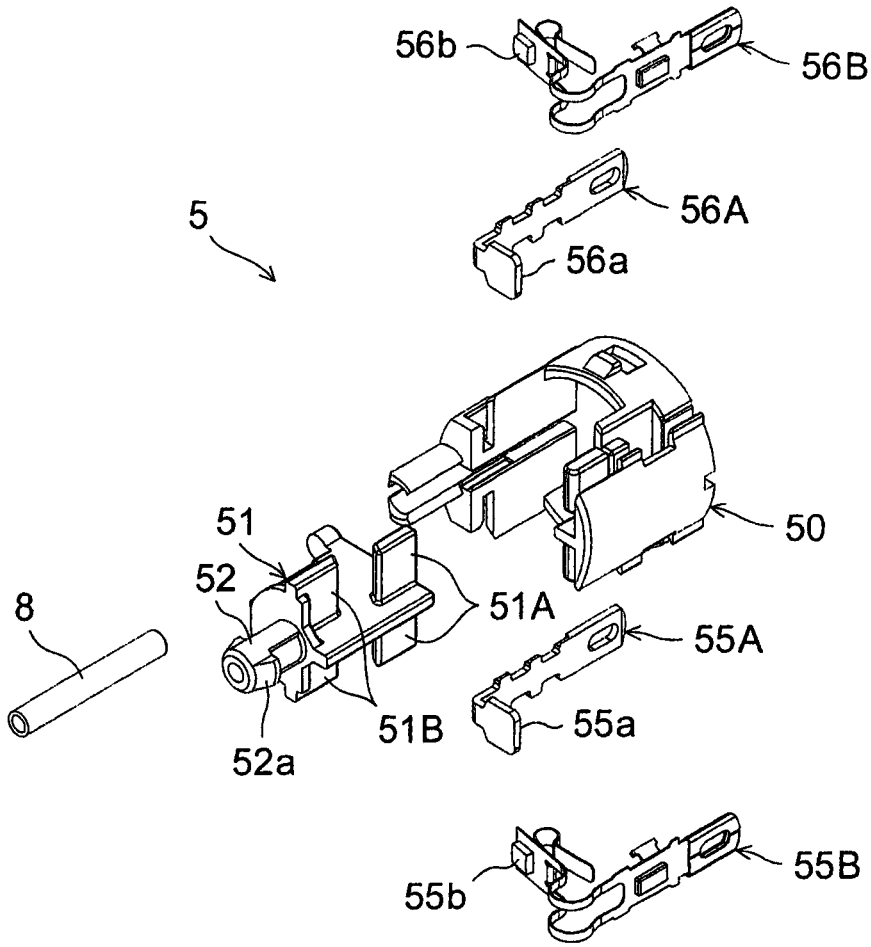
FIG. 9 is an exploded perspective view of contact units of the push button switch of FIG. 8.

As shown in FIG. 9, the base 50 is provided with a pair of fixed terminals 55A, 56A and a pair of movable terminals 55B, 56B positioned opposite the fixed terminals 55A, 56A, respectively. Each of the fixed terminals 55A, 56A is a member of a general L-shape fixedly attached to the base 20 and has a fixed contact (or a first contact) 55*a*, 56*a* provided and fixedly attached in the base 50. The movable terminals 55B, 56B have movable contacts (or a second contact) 55*b*, 56*b* respectively which are adapted to connect with and disconnect from the fixed contacts 55*a*, 56*a* in the base 50. Also, inside the base 50, there is provided a coil spring 8 extending in the axial direction. As shown in FIG. 1A, an end of the coil spring 8 presses against a bottom portion of the slider 51 and the other end of the coil spring 8 presses against an inner wall portion of the cylindrical portion 31 of the switch case 3. The coil spring 8 is provided as a biasing means to bias the slider 51 downwardly, but it is merely an auxiliary means and not essential in the present invention.

Figure 2:
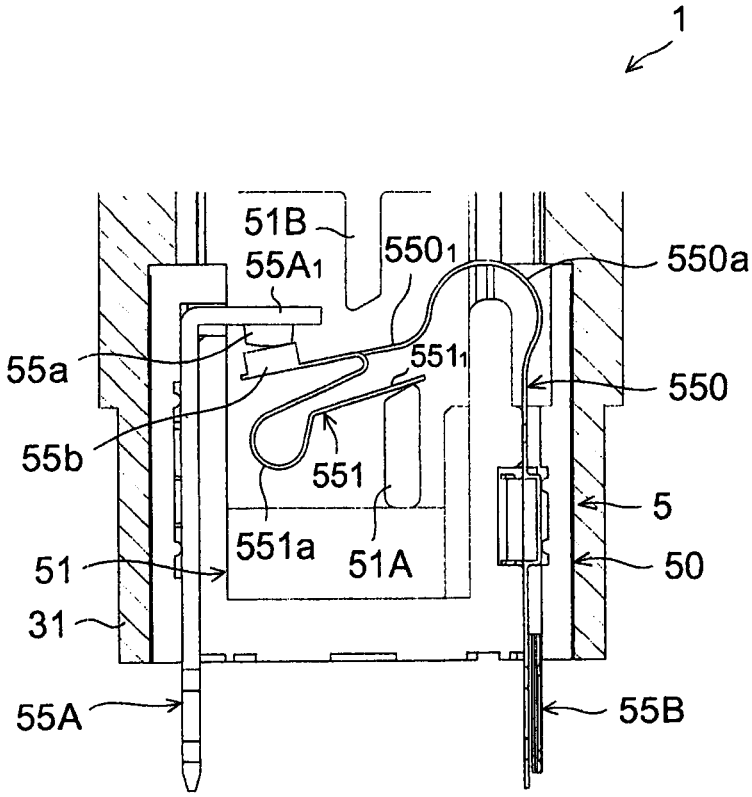
FIG. 2 is an enlarged view of the push button switch of FIG. 1B illustrating a switch case portion thereof.
Figure 2A:
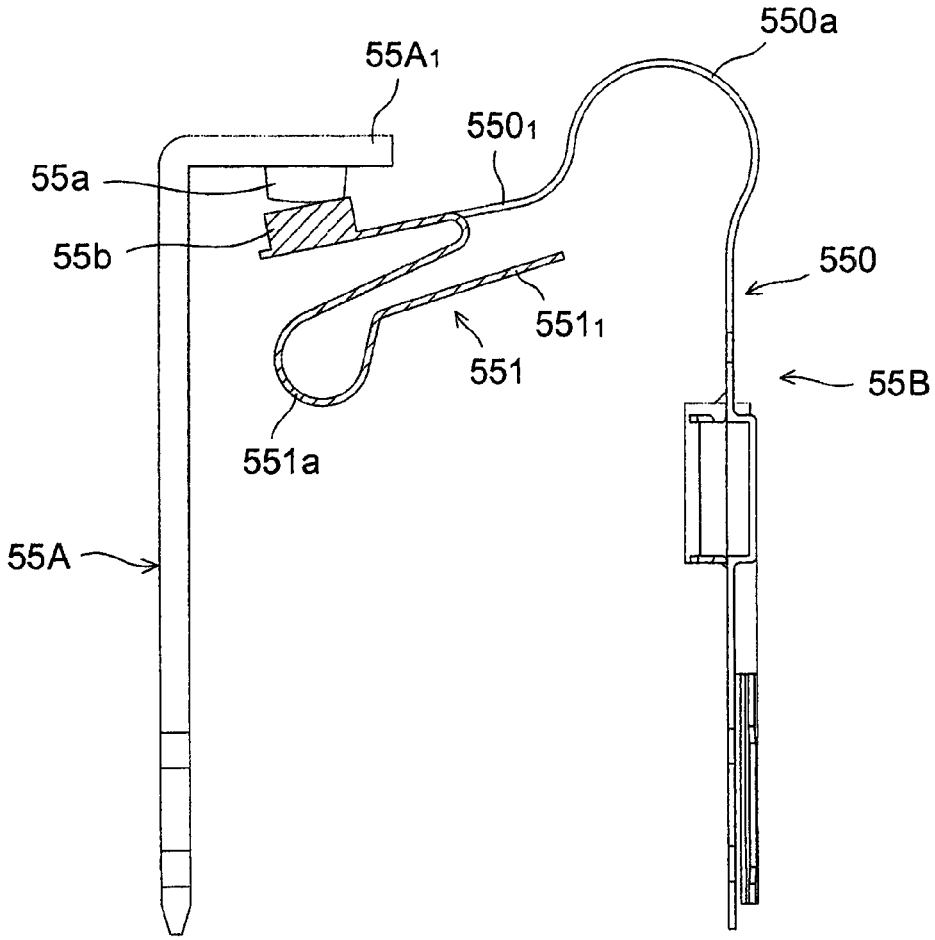
FIG. 2A is an enlarged view of the push button switch of FIG. 2 illustrating a contact portion thereof.

As shown in FIGS. 2 and 2A, the fixed terminal 55A is formed of a relatively thick conductive band-shaped member that is bent into an L-shape. The fixed contact 55A is provided at a fixed piece $\mathbf{55}A_1$ that extends in the direction perpendicular to the axial direction inside the base 50. In addition, the fixed terminal 56A has a similar structure and the detailed explanation will be omitted here.

The movable terminal 55B is formed of a first leaf spring 550 and a second leaf spring 551. The first leaf spring 550 is formed of a relatively thin conductive band-shaped member that is bent into a general L-shape. The first leaf spring 550 has the movable contact 55*b* at one end and a flexure 550*a* at a generally central position between the one end and the other end of the first leaf spring 550. The second leaf spring 551 is generally U-shaped. One end of the second leaf spring 551 is coupled to the first leaf spring 550 on the back side of the movable contact 55*b* of the first leaf spring 550. The second leaf spring 551 has a flexure 551*a* at a generally central position between the one end and the other end of the second leaf spring 551.

A movable piece $\mathbf{550}_1$ of the first leaf spring 550 that extends linearly toward the inside of the base 50 from the flexure 550*a* has flexibility (i.e. resilience) in the substantially axial direction. Also, the second leaf spring 551 is formed in such a way that a portion of the first leaf spring 550 is cut out to be deformed into a generally U-shape. The movable piece $\mathbf{551}_1$ of the second leaf spring 551 extending linearly toward the inside of the base 50 from the flexure 551*a* has flexibility (i.e. resilience) in the substantially axial direction. In addition, the movable contact 56B has a similar structure and its detailed explanation will be omitted. In the initial position where the contacts are contacted with each other as shown in FIGS. 1A, 1B, 2 and 2A, the movable contact 55*b* is biased to open relative to and disengage from the fixed contact 55*a* due to resilience of the first leaf spring 550. That is, the first leaf spring 550 functions as an opening and disengaging means of the contacts.

On the other hand, the slider 51 has a first finger portion 51A and a second finger portion 51B as shown in FIGS. 1B, 2 and 9. The first finger portion 51A is disposed on a side (i.e. away from the push button 2) with respect to the movable piece $\mathbf{550}_1$ of the first leaf spring 550 and the movable piece $\mathbf{551}_1$ of the second leaf spring 551. The first finger portion 51A is adapted to cause the movable contact 55*b* to contact the fixed contact 55*a* by contacting the movable piece $\mathbf{551}_1$. The second finger portion 51B is disposed on the other side (i.e. close to the push button 2) with respect to the movable piece $\mathbf{550}_1$ of the first leaf spring 550 and the movable piece $\mathbf{551}_1$ of the second leaf spring 551. The second finger portion 51B is adapted to cause the movable contact 55*b* to move away from the fixed contact 55*a* by contacting the movable piece $\mathbf{550}_1$.

In the initial position shown in FIGS. 1B and 2, the first finger portion 51A of the slider 51 comes into contact with the movable piece $\mathbf{551}_1$ of the second leaf spring 551 to displace the movable piece $\mathbf{551}_1$ upwardly. Thereby, the movable piece $\mathbf{550}_1$ of the first leaf spring 550 is displaced upwardly to cause the movable contact 55*b* to get into contact with the fixed contact 55*a*. Additionally, at this juncture, in the state that the first finger portion 51A is not in contact with the movable piece $\mathbf{551}_1$ and displacement of the movable piece $\mathbf{551}_1$ is zero, displacement of the movable piece $\mathbf{550}_1$ of the first leaf spring 550 remains zero as well and the movable contact 55*b* is spaced away from the fixed contact 55*a*.

As is clearly shown in FIG. 2A, the flexure 550*a* of the first leaf spring 550 is formed of an arc-shaped portion that bulges outwardly from a generally L-shaped corner of the first leaf spring 550. Similarly, the flexure 551*a* of the second leaf spring 551 is formed of an arc-shaped portion that bulges outwardly from a generally U-shaped bend of the second leaf spring 551. Also, in this embodiment, radius of curvature of the arc-shaped portion forming the flexure 550*a* of the first leaf spring 550 is greater than radius of curvature of the arc-shaped portion forming the flexure 551*a* of the second leaf spring 551.

Then, operation of the above-mentioned push button switch 1 will be explained in the operational order with reference to FIGS. 1 to 7.

[Initial Position]

At the initial position of the push button switch 1 in which the push button 2 is not pressed, as described in reference to FIG. 1A, each of the hook portions 71 (see FIG. 8) of the trigger spring 7 is in contact with the slope $\mathbf{40}c_1$ on the lower side of the bulge 40*c* of the operating spindle 4 from below. Also, as explained in reference to FIGS. 1B and 2, the first finger portion 51A of the slider 51 comes into contact with the movable piece $\mathbf{551}_1$ of the second leaf spring 551 and the movable piece $\mathbf{551}_1$ is displaced upwardly thereby causing the movable piece $\mathbf{550}_1$ of the first leaf spring 550 to be displaced upwardly such that the movable contact 55*b* comes into contact with the fixed contact 55*a*.

On this occasion, the movable contact 55*b* at the distal end of the movable piece $\mathbf{550}_1$ of the first leaf spring 550 is biased to open relative to and move away from the fixed contact 55*a* due to resilience of the first leaf spring 550. That is, at this juncture, in the state that the first finger portion 51A is not in contact with the movable piece $\mathbf{551}_1$ of the second leaf spring 551 and displacement of the movable piece $\mathbf{551}_1$ is zero, displacement of the movable piece $\mathbf{550}_1$ of the first leaf spring 550 remains zero as well and the movable contact 55*b* is adapted to be open relative to and spaced away from the fixed contact 55*a*.

[Preliminary Press Position]

Figure 3A:
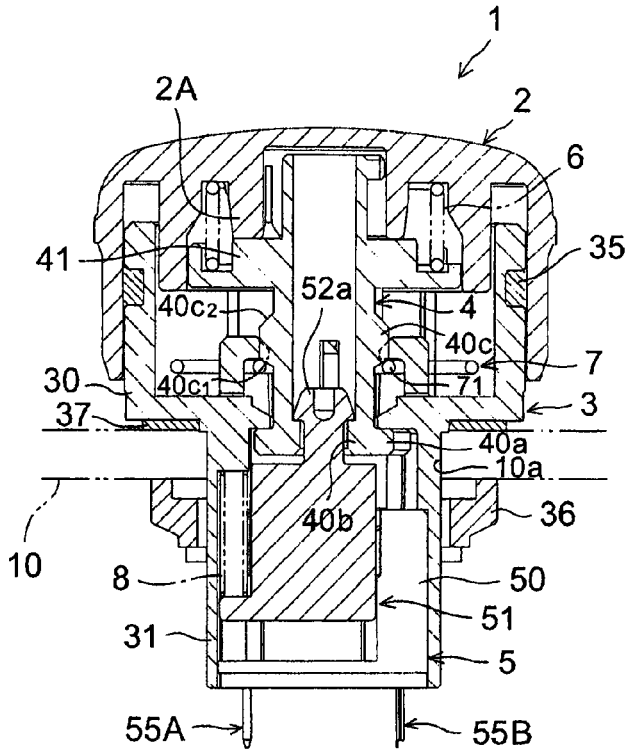
FIG. 3A is a longitudinal sectional view of a push button switch at a preliminary press position along the longitudinal centerline according to an embodiment of the present invention.
Figure 3B:
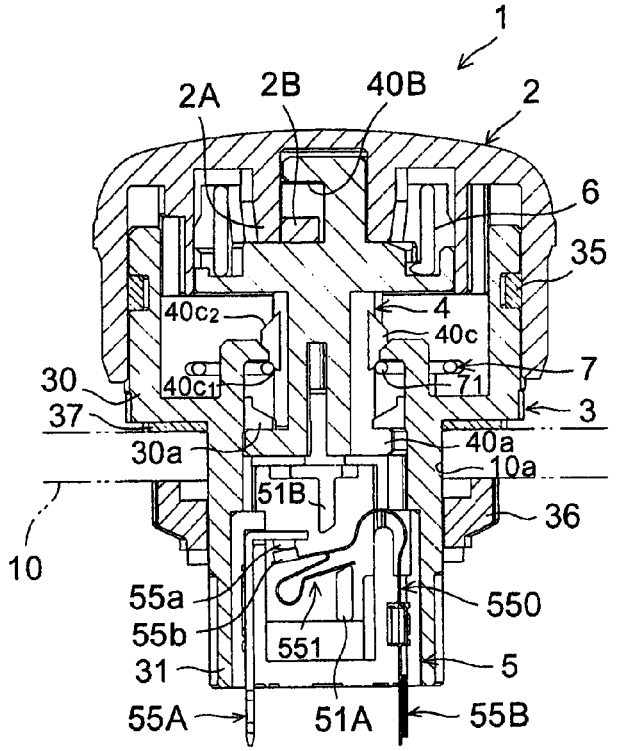
FIG. 3B is a longitudinal sectional view of the push button switch of FIG. 3A taken along the longitudinal line passing through the contacts thereof.

At a preliminary press position in which only the push button 2 is slightly pressed from the state of the initial position, as shown in FIGS. 3A and 3B, the push button 2 is pushed downwardly against the force of the coil spring 6 and the annular protrusion 2A of the push button 2 comes into contact with the flange portion 41 of the operating spindle 4. On this occasion, the operating spindle 4 is not pushed downwardly and thus the axial positions of the operating spindle 4 and the slider 51 are not changed from the initial position.

Therefore, positional relation between each of the hook portions 71 of the trigger spring 7 and the slope $\mathbf{40}c_1$ of the bulge 40*c* of the operating spindle 4, displacement of the movable piece $\mathbf{551}_1$ of the second leaf spring 551, displacement of the movable piece $\mathbf{550}_1$ of the first leaf spring 550, and the contact state and pressure between the movable contact 55*b* and the fixed contact 55*a* are not changed from the initial position.

[Position Immediately Before Climbing Over Hook Portions]

Figure 4A:
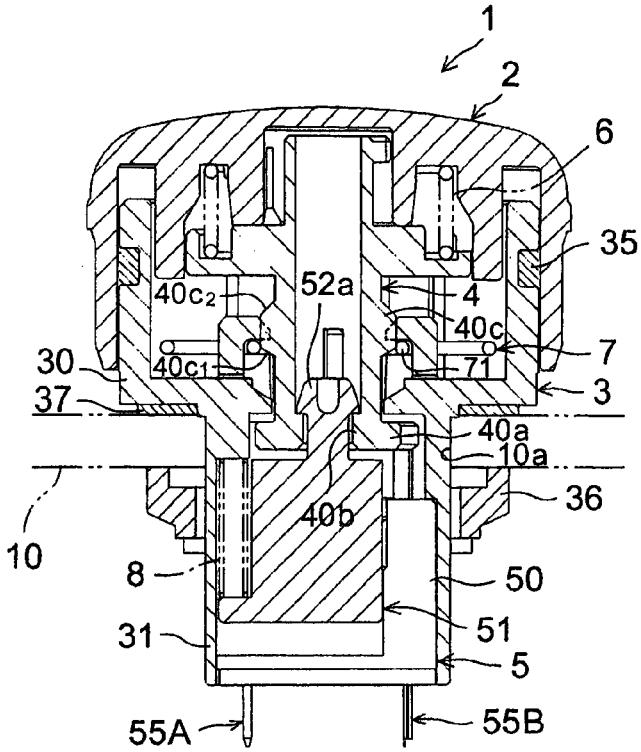
FIG. 4A is a longitudinal sectional view of a push button switch taken along the longitudinal centerline at a position immediately before climbing over hook portions according to an embodiment of the present invention.
Figure 4B:
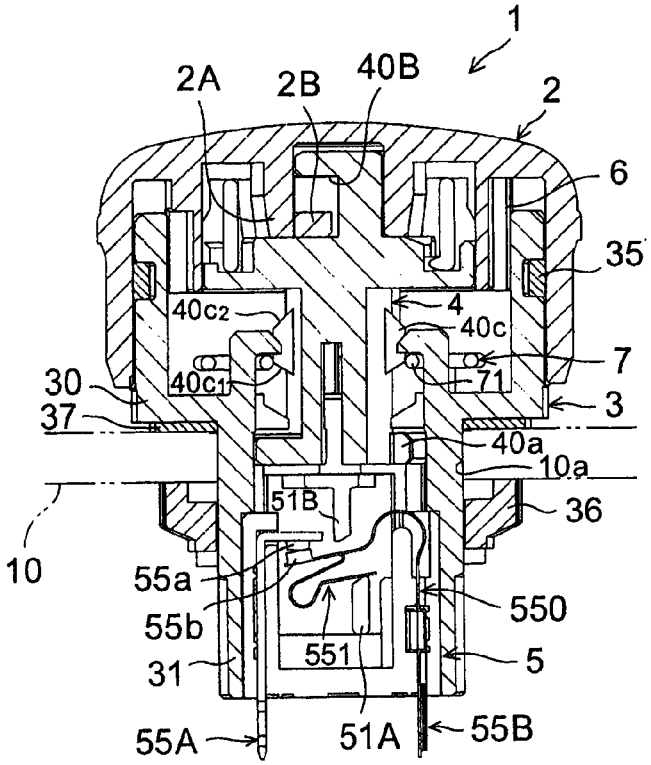
FIG. 4B is a longitudinal sectional view of the push button switch of FIG. 4A taken along the longitudinal line passing through the contacts thereof.

When the push button 2 is pushed further downwardly from the preliminary press position, the push button switch 1 shifts to the position immediately before the slopes $\mathbf{40}c_1$ climb over hook portions 71 shown in FIGS. 4A and 4B. At this juncture, the operating spindle 4 is slightly pushed downwardly together with the push button 2 and thus each of the slopes $\mathbf{40}c_1$ of the bulges 40*c* of the operating spindle 4 enlarges each of the hook portions 71 of the trigger spring 7 radially outwardly. As a result of this, the hook portions 71 of the trigger spring 7 shift to the state that they are about to disengage from the corresponding slopes $\mathbf{40}c_1$ of the bulges 40*c* of the operating spindle 4, in other words, the slopes $\mathbf{40}c_1$ of the bulges 40*c* are about to climb over the hook portions 71 of the trigger spring 7.

Also, on this occasion, as the push button 2 is pressed downwardly, the slider 51 is slightly pressed downwardly together with the operating spindle 4 and thus displacement of the movable piece $\mathbf{551}_1$ of the second leaf spring 551 abutting the first finger portion 51A of the slider 51 is decreased. However, in this case as well, the movable piece $\mathbf{550}_1$ of the first leaf spring 550 is displaced due to displacement of the movable piece $\mathbf{551}_1$ of the second leaf spring 551, thereby maintaining the contact state and pressure between the movable contact 55*b* and the fixed contact 55*a*.

[Position Immediately after Climbing Over Hook Portions]

Figure 5A:
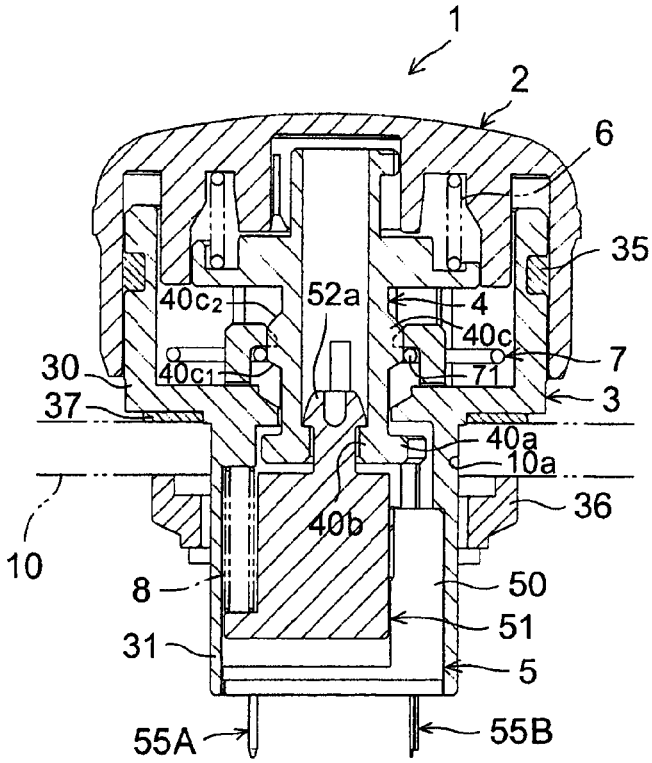
FIG. 5A is a longitudinal sectional view of a push button switch taken along the longitudinal centerline at a position immediately after climbing over hook portions and immediately before a lock position according to an embodiment of the present invention.
Figure 5B:
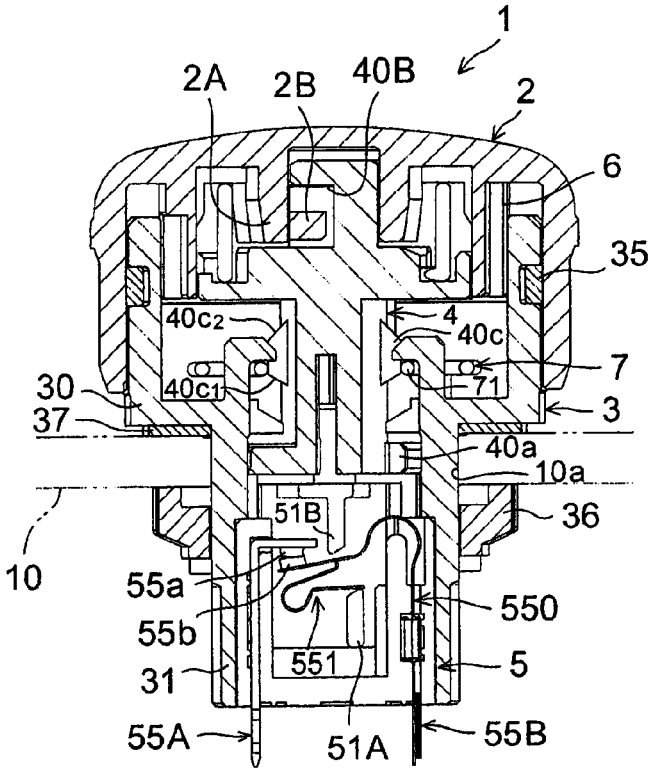
FIG. 5B is a longitudinal sectional view of the push button switch of FIG. 5A taken along the longitudinal line passing through the contacts thereof.

When the push button 2 is pushed further downwardly from the position immediately before climbing over hook portions, the push button switch 1 shifts to the position immediately after the slopes $\mathbf{40}c_1$ have climbed over hook portions 71 shown in FIGS. 5A and 5B. At this juncture, the operating spindle 4 is slightly pushed downwardly together with the push button 2 and thus each of the slopes $\mathbf{40}c_1$ of the bulges 40*c* of the operating spindle 4 further enlarges each of the hook portions 71 of the trigger spring 7 radially outwardly. As a result of this, the hook portions 71 of the trigger spring 7 shift to the state immediately after they have just disengaged from the corresponding slopes $\mathbf{40}c_1$ of the bulges 40*c* of the operating spindle 4, in other words, the slopes $\mathbf{40}c_1$ of the bulges 40*c* have just climbed over the hook portions 71 of the trigger spring 7.

Also, on this occasion, as the push button 2 is pressed downwardly, the slider 51 is slightly pressed downwardly together with the operating spindle 4 and thus displacement of the movable piece $\mathbf{551}_1$ of the second leaf spring 551 abutting the first finger portion 51A of the slider 51 is further decreased from the position immediately before the slopes $40c_1$ of the bulges 40*c* climbs over the hook portions 71 of the trigger spring 7. However, in this case as well, the movable piece $550_1$ of the first leaf spring 550 is displaced due to displacement of the movable piece $551_1$ of the second leaf spring 551, thereby maintaining the contact state and pressure between the movable contact 55*b* and the fixed contact 55*a*.

Likewise, in the above-mentioned position immediately after climbing over hook portions from the position immediately before climbing over hook portions, resiliently repellent force of the coil spring 6 which has been compression-deformed as the push button 2 is pressed downwardly acts upon the operating spindle 4. Also, the resiliently restoring force due to deformation of the first leaf spring 550 and the second leaf spring 551 biases the slider 51 downwardly.

[Zero-Displacement Position of Leaf Spring]

Figure 6:
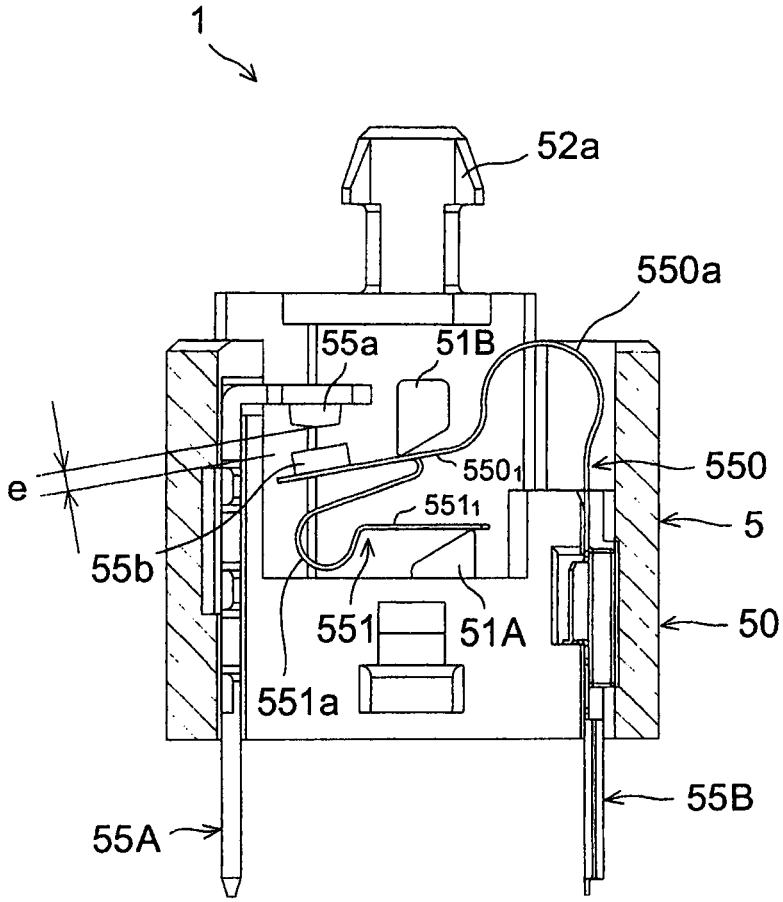
FIG. 6 is an enlarged longitudinal sectional view of a portion of a push button switch taken along the longitudinal line passing through the contacts thereof according to an embodiment of the present invention, illustrating the state at the moment when displacement of each of the leaf springs has become zero due to a travel of a slider immediately before a lock position.

The moment when the hook portions 71 of the trigger spring 7 have disengaged from the corresponding slopes $40c_1$ of the bulges 40*c* of the operating spindle 4 placed in the position immediately after climbing over hook portions, the operating spindle 4 moves downwardly due to the resiliently repellent force of the coil spring 6, the resiliently restoring force of the first and second leaf springs 550, 551, and auxiliary resiliently repellent force of the coil spring 8. Thereby, the first finger portion 51A of the slider 51 leaves the movable piece $551_1$ of the second leaf spring 551 and then as shown in FIG. 6, the push button switch 1 shifts to the position of zero displacement of the first and second leaf springs 550, 551. On this occasion, the first and second leaf springs 550, 551 are placed in the state of free length (i.e. zero displacement) between the first finger portion 51A and the second finger portion 51B of the slider 51. Also, at this juncture, there is formed a gap e between the movable contact 55*b* and the fixed contact 55*a* and the contacts move onto the state of out of contact. Then, the push button switch 1 is turned off and the machine tool is put into emergency-shutdown.

[Lock Position]

Figure 7A:
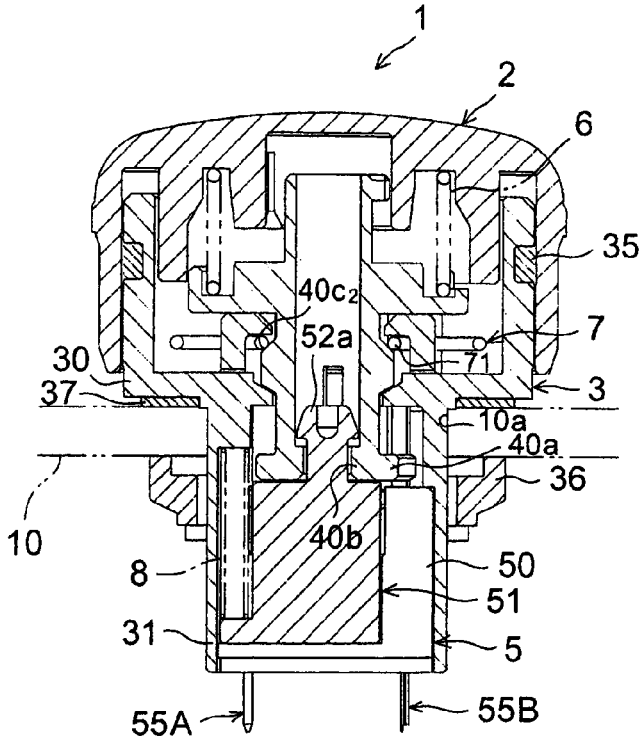
FIG. 7A is a longitudinal sectional view of a push button switch at a lock position along the longitudinal centerline according to an embodiment of the present invention.
Figure 7B:
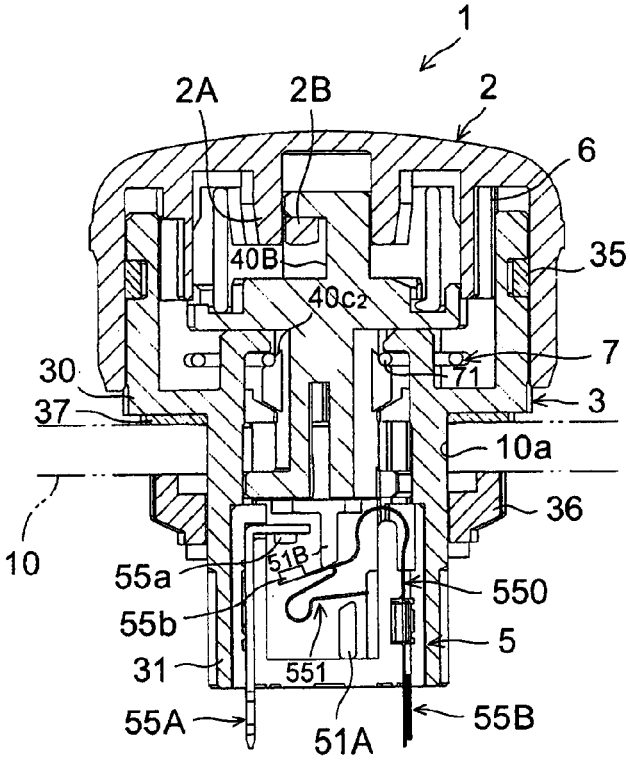
FIG. 7B is a longitudinal sectional view of the push button switch of FIG. 7A taken along the longitudinal line passing through the contacts thereof.

When the push button 2 is pushed downwardly from the position immediately before climbing over hook portions shown in FIGS. 4A and 4B, the push button switch 1 shifts to the lock position shown in FIGS. 7A and 7B via the position immediately after climbing over hook portions (see FIGS. 5A and 5B) and the zero-displacement position of the leaf spring (see FIG. 6).

In this lock position, as shown in FIGS. 7A and 7B, the operating spindle 4 travels further downwardly from the position (not shown) of FIG. 6 due to the resiliently repellent force of the coil spring 6. At this juncture, the slopes $40c_2$ on the upper side of the bulges 40*c* move onto the position opposite the corresponding hook portions 71 of the trigger spring 7. Then, the hook portions 71 of the trigger spring 7 that has been enlarged contract and return to the original state due to their resiliently restoring force and the hook portions 71 thus contact the slopes $40c_2$ of the bulges 40*c*. Also, at this juncture, the slider 51 also moves further downwardly from the position of FIG. 6 thereby causing the second finger portion 51B of the slider 51 to contact the first leaf spring 550 from above to displace the movable piece $550_1$ of the first leaf spring 550 downwardly. As a result, the movable contact 55*b* is open relative to and away from the fixed contact 55*a*.

In this case, elastic energy stored in the first and second leaf springs 550, 551 by means of elastic deformation of the movable piece $550_1$ due to contact of the second finger portion 51B of the slider 51 in the lock position is predetermined at a far smaller value than elastic energy that has been stored in the first and second leaf springs 550, 551 by means of elastic deformation of the movable pieces $550_1$, $551_1$ due to contact of the first finger portion 51A of the slider 51 in the initial position. Thereby, even in the event that the push button switch 1 is damaged, the contacts can be prevented from returning to the state in contact with each other and thus safety-Potentials® function is maintained.

[Resetting Operation]

When resetting the push button 2 at its original initial position, an operator has only to pull the push button 2 out from the state of the lock position of FIGS. 7A and 7B. Since the radially extending recess 40B of the operating spindle 4 is engaged with the engaging projection 2B of the push button 2 in the lock position, as the push button 2 is pulled out the operating spindle 4 also moves upwardly. At the moment, the hook portions 71 of the trigger spring 7 travel radially outwardly to enlarge along the corresponding slopes $40c_2$ of the bulges 40*c* of the operating spindle 4. As the hook portions 71 further enlarge to leave the slopes $40c_2$, the push button 2 and the operating spindle 4 shift further upwardly. The moment when the slopes $40c_2$ of the bulges 40*c* of the operating spindle 4 move onto the position opposite the corresponding hook portions 71 of the trigger spring 7, the hook portions 71 that were enlarged contract due to their resiliently restoring force and come into contact with the slopes $40c_1$ on the lower side of the bulges 40*c* of the operating spindle 4.

Also, as the operating spindle 4 travels, the slider 51 also moves upwardly through the engagement of the projection 40*b* of the operating spindle 4 with the protrusion 52*a* of the slider 51.

At this juncture, by the time the push button switch 1 returns to the position of zero displacement of leaf spring, the first leaf spring 550 tries to return to the original position due to its resiliently repellent force and the movable piece $550_1$ of the first leaf spring 550 is displaced upwardly. Thereafter, due to a press of the first finger portion 51A against the movable piece $551_1$ of the second leaf spring 551, first, the movable piece $550_1$ of the first leaf spring 550 with the flexure 550*a* of an arc-shape of a greater radius of curvature is displaced upwardly. Then, after the movable contact 55*b* comes into contact with the fixed contact 55*a*, the movable piece $551_1$ of the second leaf spring 551 with the flexure 551*a* of an arc-shape of a smaller radius of curvature is displaced upwardly. In such a manner, the press button switch 1 returns to the initial position.

According to the above-mentioned embodiment, the first leaf spring 550 as a contact-opening-biasing means is provided with the movable contacts 55*b* or 56*b* in the switch case 3, there is no need to provide a spring as an opening-biasing means discretely from the contacts and the first spring 550 per se comes to function as a conductive plate with a contact. Thereby, the number of components of the push button switch can be reduced and a manufacturing and assembly cost can be decreased.

Also, in this case, since there is provided the movable contact 55*b* or 56*b* at an end of the first leaf spring 550, the contacts can be made a single-break structure thus decreasing the number of contacts.

Moreover, in this case, since the biasing means of the movable contact 55*b* is formed of two kinds of springs, i.e. the first leaf spring 550 and the second leaf spring 551, a stress exerted to the spring at the time of displacement of the spring can be dispersed compared with the case in which a single leaf spring is used. Thereby, not only each stress imparted to each of the leaf springs can be mitigated but also opening timing of the movable contacts 55*b*, 56*b* can be adjusted by properly determining stiffness (or rate) of each of the springs.

Furthermore, since the flexures 550*a*, 551*a* of the first and second leaf springs 550, 551 are formed of arc-shaped portions that bulge outwardly from the corner portion of a general L-shape or the bend of a general U-shape, respectively, stiffness of the first and second leaf springs 550, 551 can be adjusted by properly determining radius of curvature of each of the flexures 550*a*, 551*a*.

As shown in this embodiment, in the event that radius of curvature of the arc-shaped portion of the first leaf spring 550 is determined at a greater value than radius of curvature of the arc-shaped portion of the second leaf spring 551, bending rigidity of the arc-shaped portion of the first leaf spring 550 becomes smaller than bending rigidity of the arc-shaped portion of the second leaf spring 551 and thus the arc-shaped portion of the first leaf spring 550 becomes easier to bending-deform than the arc-shaped portion of the second leaf spring 551. In this case, when the first finger portion 51A in the switch case 3 comes into contact with the distal end of the movable piece $\mathbf{551}_1$ of the second leaf spring 551, the first leaf spring 550 is easier to deform than the second leaf spring 551 thus adjusting opening timing of the contacts.

To the contrary, in the event that radius of curvature of the arc-shaped portion of the second leaf spring 551 is determined at a greater value than radius of curvature of the arc-shaped portion of the first leaf spring 550, bending rigidity of the arc-shaped portion of the second leaf spring 551 becomes smaller than bending rigidity of the arc-shaped portion of the first leaf spring 550 and thus the arc-shaped portion of the second leaf spring 551 becomes easier to bending-deform than the arc-shaped portion of the first leaf spring 550. In this case, when the first finger portion 51A in the switch case 3 comes into contact with the distal end of the movable piece $\mathbf{551}_1$ of the second leaf spring 551, the second leaf spring 551 is easier to deform than the first leaf spring 550 thus adjusting opening timing of the contacts.

Also, in the above-mentioned embodiment, both of the flexures 550*a* and 551*a* of the first and second leaf springs 550, 551 were formed of arc-shaped portions that bulge outwardly, but either one of these flexures 550*a*, 551*a* may be formed of an arc-shaped portion.

In this case, a leaf spring with a flexure having an arc-shaped portion is easier to deform thus regulating opening timing of the contacts as with the above-mentioned embodiment.

Additionally, in the above-mentioned embodiment, the movable contact 55*b* is caused to come into contact with the fixed contact 55*a* due to contact of the first finger portion 51A with the movable piece $\mathbf{551}_1$ of the second leaf spring 551, which eliminates the necessity for providing a spring for press contact.

Alternative Embodiment

Figure 10:
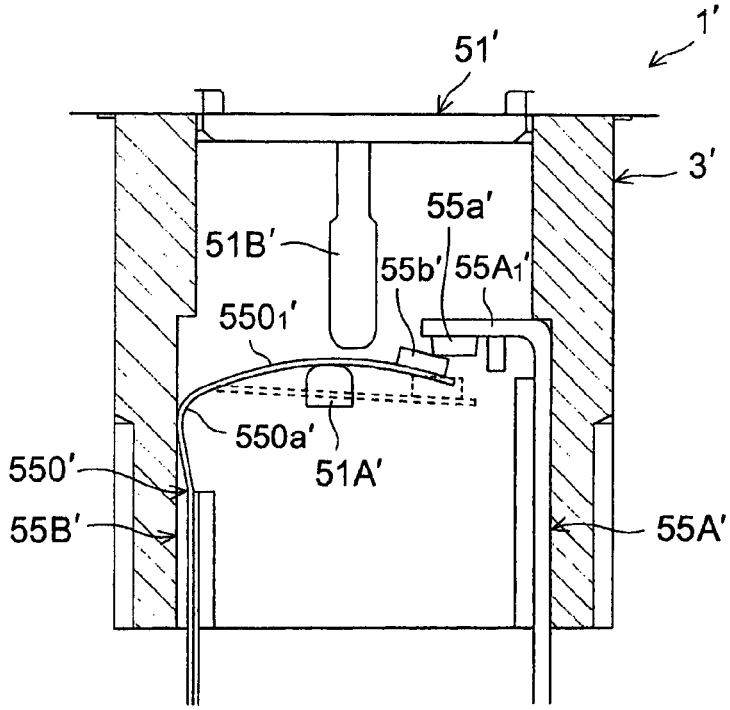
FIG. 10 is a longitudinal sectional view of a push button switch at an initial position taken along the longitudinal line passing through the contacts thereof according to another embodiment of the present invention, which corresponds to FIGS. 1B and 2.
Figure 11:
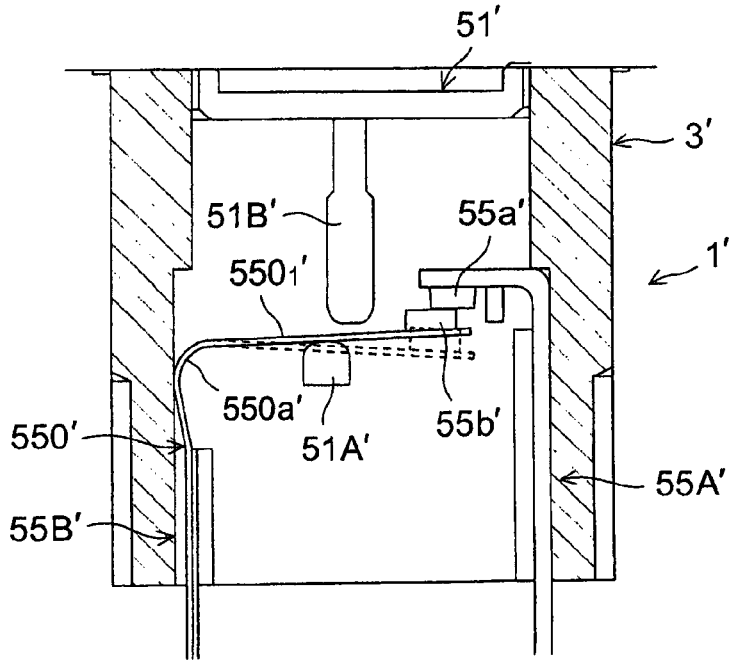
FIG. 11 is a longitudinal sectional view of a push button switch taken along the longitudinal line passing through the contacts thereof at a position immediately after climbing over hook portions and immediately before a lock position according to another embodiment of the present invention, which corresponds to FIG. 5B.
Figure 12:
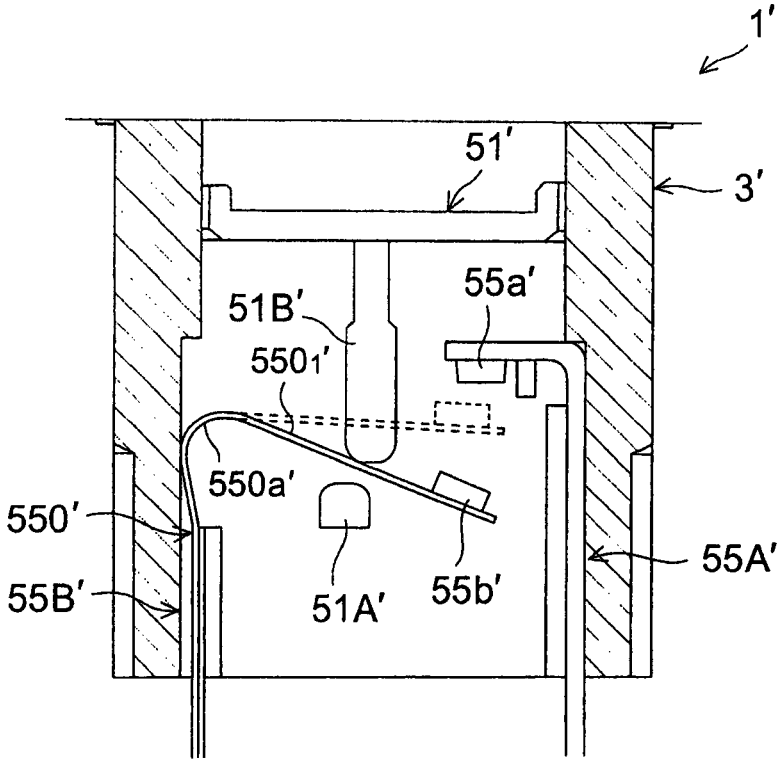
FIG. 12 is a longitudinal sectional view of a push button switch at a lock position along the longitudinal line passing through the contacts thereof according to another embodiment of the present invention, which corresponds to FIG. 7B.

FIGS. 10 to 12 illustrate a push button switch for emergency stop according to another embodiment of the present invention. In these drawings, like reference numbers indicate identical or functionally similar elements. Here, only a switch case portion for a push button switch is shown for illustration purposes.

As shown in FIGS. 10 to 12, there are provided a fixed terminal 55A' and a movable terminal 55B' in a switch case 3' of a push button switch 1'. The fixed terminal 55B' is a member of a general L-shape provided in the switch case 3' and has a fixed contact (or first contact) 55*a*' fixed in the switch case 3'. The movable terminal 55B' has a movable contact (or second contact) 55*b*' adapted to engage with and disengage from the fixed contact 55*a*' in the switch case 3'.

The fixed terminal 55A' is formed by bending a relatively thick band-shaped conductive plate in an L-shape and the fixed contact 55*a*' is provided at a fixed piece $\mathbf{55A}_1$' extending in the direction generally perpendicular to the axial direction in the switch case 3'. The movable terminal 55B' is formed of a leaf spring 550' composed of a relatively thin band-shaped conductive plate of a general L-shape and has a movable contact 55*b*' at one end of the leaf spring 550' and a flexure 550*a*' of a general arc-shape at an intermediate position between the one end and the other end of the leaf spring 550'.

The leaf spring 550' has a movable piece $\mathbf{550}_1$' which extends toward the inside of the switch case 3' from the flexure 550*a*' and has resilience in the axial direction. The movable contact 55*b*', as shown in a broken line in FIGS. 10 and 11, is adapted to be placed at a position in which the movable contact 55*b*' is open relative to and spaced apart from the fixed contact 55*a*' at zero displacement (i.e. free length state) of the leaf spring 550' by means of elasticity of the leaf spring 550'.

There is provided a slider 51' slidable in the axial direction in the switch case 3'. The slider 51' is adapted to slide in the switch case 3' in conjunction with operation of a push button (not shown), similar to the above-mentioned embodiment. The slider 51' is provided with a first finger portion 51A' and a second finger portion 51B'. The first finger portion 51A' is disposed on a lower side of the movable piece $\mathbf{550}_1$' of the leaf spring 550' and adapted to come into contact with the movable piece $\mathbf{550}_1$' to cause the movable contact 55*b*' to contact the fixed contact 55*a*'. The second finger portion 51B' is disposed on an upper side of the movable piece $\mathbf{550}_1$' of the leaf spring 550' and adapted to come into contact with the movable piece $\mathbf{550}_1$' to cause the movable contact 55*b*' to move away from the fixed contact 55*a'*.

In an initial position shown in FIG. 10, the first finger portion 51A' of the slider 51' is in contact with the movable piece $\mathbf{550}_1$' of the leaf spring 550' and the movable piece $\mathbf{550}_1$' is displaced upwardly thus making the movable contact 55*b*' get into contact with the fixed contact 55*a*'. Additionally, in the state that the first finger portion 51A' is not in contact with the movable piece $\mathbf{550}_1$' and displacement of the movable piece $\mathbf{550}_1$' is zero, as explained above, the movable contact 55*b*' is open relative to and spaced away from the fixed contact 55*a*'. That is, the leaf spring 550' functions as an opening-biasing means of contacts.

This is not shown in the drawings, but the push button switch 1' also has a trigger means similar to the trigger spring of the above-mentioned embodiment. The trigger means disengages the axial engagement of an operating spindle in the push button when a stroke of the push button exceeds a certain predetermined extent, and causes the operating spindle to move in the axial direction together with the push button.

Then, operation of the push button switch 1' will be explained hereinafter.

First, in the initial position of the push button switch 1' where the push button is not pushed, as explained in reference to FIG. 10, the first finger portion 51A' of the slider 51' is in contact with the movable piece $\mathbf{550}_1$' of the leaf spring 550' and the movable piece $\mathbf{550}_1$' is displaced upwardly thus making the movable contact 55*b*' come into contact with the fixed contact 55*a*'. On this occasion, the movable contact 55*b*' at the distal end of the movable piece $\mathbf{550}_1$' of the leaf spring 550' is biased to open relative to and move away from the fixed contact 55*a*' due to elastic restoring force of the movable piece $\mathbf{550}_1$'.

Then, when the push button is pressed, the operating spindle (not shown) in the push button is pressed downwardly. At this moment, the trigger means is activated and thus the first finger portion 51A' together with the slider 51' moves downwardly as shown in FIG. 11. On this occasion, displacement of the movable piece $550_1$' of the leaf spring 550' contacting the first finger portion 51A' is decreased and contact pressure of the movable contact 55*b*' relative to the fixed contact 55*a*' is thus decreased, but a contact state of the contacts 55*a*' and 55*b*' in contact with each other is maintained. Also, in this case as well, the slider 51' is biased downwardly due to elastic restoring force of the movable piece $550_1$' of the leaf spring 550'.

By means of operation of the push button, as the slider 51' travels downwardly, the movable piece $550_1$' of the leaf spring 550' is displaced from the position of FIG. 11 through the position of zero displacement (see broken lines of FIG. 11) to the lock position of FIG. 12.

In the position of zero displacement, there is formed a gap between the movable contact 55*b*' and the fixed contact 55*a*' to cause the contacts to be out of contact. Thereby, the push button switch 1' is turned off and the machine such as the machine tool has thus emergency-stopped. In the lock position shown in FIG. 12, the second finger portion 51B' of the slider 51' comes into contact with the leaf spring 550' from above to cause the movable piece $550_1$' of the leaf spring 550' to move downwardly. Thereby, the movable contact 55*b*' is open relative to and spaced away from the fixed contact 55*a'*.

In this case, elastic energy stored in the leaf spring 550' in the lock position by means of elastic deformation of the movable piece $550_1$' due to contact of the second finger portion 51B' of the slider 51' is predetermined at a smaller value than elastic energy that has been stored in the leaf spring 550' in the initial position by means of elastic deformation of the movable piece $550_1$' due to contact of the first finger portion 51A' of the slider 51'. Thereby, even in the event that the push button switch 1' is damaged, contacts can be prevented from returning to the contact state thus displaying Safety-Potential® function.

In this case as well, since the leaf spring 550' as a contact-opening-biasing means is provided with the movable contacts 55*b*' in the switch case 3, there is no need to provide a spring as an opening-biasing means discretely from the contacts and the spring 550' per se comes to function as a conductive plate with a contact. Thereby, the number of components of the push button switch can be reduced and a manufacturing and assembly cost can be decreased.

In each of the embodiments mentioned above, the operating switch according to the present invention was applied to a push-button-type emergency switch, but the application of the present invention is not limited to an emergency switch and the present invention is also applicable to a general normally closed switch in which normally closed contacts are caused to be open due to operation of a push button. Moreover, the present invention also has application to switches such as a selector switch, a cam switch, a safety switch and the like.

INDUSTRIAL APPLICABILITY

As stated above, the present invention is useful for an operation switch such as a push button switch and the like, and suitable especially to a switch that requires decrease in cost by reducing the number of components.

The invention claimed is:

1. An electrical switch comprising:

a switch case;

an actuating member movably arranged relative to said switch case, and adapted to be manually operated;

a fixed contact secured in said switch case;

a movable contact;

a spring arrangement including a fixed portion that is secured in said switch case, a movable portion on which said movable contact is arranged, and a first flexibly deflectable portion between said movable portion and said fixed portion, wherein said movable contact is movable between a closed position in which said movable contact is in contact with said fixed contact and an open position in which said movable contact is spaced away from and out of contact with said fixed contact, and wherein said spring arrangement exerts a spring bias that biases said movable contact away from said closed position toward said open position; and a closing press member and an opening press member that are movably arranged in said switch case and operatively coupled to said actuating member so as to move in response to a manually operated motion of said actuating member, wherein said closing press member is arranged, configured and operable to press against said spring arrangement and move said movable contact to said closed position in a first motion direction, and wherein said opening press member is arranged, configured and operable to press against said spring arrangement and move said movable contact to said open position in a second motion direction.

2. The electrical switch according to claim 1, further comprising a slider that is slidably arranged in said switch case and operatively coupled to said actuating member so as to move in response to the manually operated motion of said actuating member, wherein said closing press member and said opening press member are each connected to said slider so that said slider, said closing press member and said opening press member move together in unison as a unit.

3. The electrical switch according to claim 1, wherein said spring arrangement further includes a distal leg and a second flexibly deflectable portion between and connecting said distal leg and said movable portion, wherein said closing press member is arranged, configured and operable to press against said distal leg to move said movable contact to said closed position in said first motion direction by moving said movable portion via said distal leg and said second flexibly deflectable portion, and wherein said opening press member is arranged, configured and operable to press against said movable portion to move said movable contact to said open position in said second motion direction.

4. The electrical switch according to claim 3, wherein said distal leg is a free leg that terminates at an unsecured free end.

5. The electrical switch according to claim 3, wherein said first flexibly deflectable portion comprises a first arc-shaped bend of said spring arrangement, said second flexibly deflectable portion comprises a second arc-shaped bend of said spring arrangement, and a first radius of curvature of said first arc-shaped bend is greater than a second radius of curvature of said second arc-shaped bend.

6. The electrical switch according to claim 3, wherein said first flexibly deflectable portion comprises a first arc-shaped bend of said spring arrangement, said second flexibly deflectable portion comprises a second arc-shaped bend of said spring arrangement, and a first radius of curvature of said first arc-shaped bend is smaller than a second radius of curvature of said second arc-shaped bend.

7. The electrical switch according to claim 1, wherein said movable portion comprises a free leg that terminates at an unsecured free end, and said movable contact is arranged adjacent to said unsecured free end.

8. The electrical switch according to claim 7, wherein said movable portion consists of said free leg, and wherein said spring arrangement consists of said free leg, said fixed portion, and said first flexibly deflectable portion which connects said free leg to said fixed portion.

9. The electrical switch according to claim 1, wherein said opening press member acts on said movable portion at a first location, said closing press member acts on said movable portion at a second location, and said first location is farther away than said second location from said first flexibly deflectable portion.

10. An operation switch including a switch case, an operating member provided at said switch case, and a first contact and a second contact held in said switch case such that said first contact and said second contact are made out of contact through operation of said operating member, said operation switch comprising an opening-biasing member provided in said switch case that biases said first contact and said second contact in contact away from each other, said opening-biasing member being formed of a leaf spring having said first contact or said second contact, wherein either one of said first contact and said second contact is a fixed contact secured in said switch case and the other of said first contact and said second contact is a movable contact fitted at an end of said leaf spring and provided closable and openable relative to said fixed contact, said operation switch further comprising a first contacting portion provided in said switch case that comes into contact with said leaf spring to cause said movable contact to contact said fixed contact, and a second contacting portion provided in said switch case that comes into contact with said leaf spring to cause said movable contact to open relative to and move away from said fixed contact.

11. The operation switch according to claim 10, wherein said leaf spring is provided such that said movable contact is located at a position spaced away and disengaged from said fixed contact when displacement of said leaf spring is zero.

12. The operation switch according to claim 10, further comprising a slider, said slider being slidable in said switch case in conjunction with action of said operating member, said slider including said first contacting portion that is disposed on one side of said leaf spring and that is adapted to come into contact with said leaf spring and said second contacting portion that is disposed on the other side of said leaf spring and that is adapted to come into contact with said leaf spring.

13. The operation switch according to claim 10, wherein said leaf spring is composed of a first leaf spring of a general L-shape and a second leaf spring of a general U-shape, said first leaf spring having said movable contact at one end and a bent portion at an intermediate position between said one end and the other end of said first leaf spring, said second leaf spring having one end coupled to a position opposite said movable contact of said first leaf spring and a bent portion at an intermediate position between said one end and the other end of said second leaf spring, a contacting portion being provided at a position corresponding to said other end of said second leaf spring in said switch case, said contacting portion being adapted to come into contact with said second leaf spring to cause said movable contact to press-contact said fixed contact.

14. The operation switch according to claim 13, wherein said first leaf spring and said second leaf spring are adapted to be located at a position in which said movable contact is open relative to and away from said fixed contact when respective displacements of said first leaf spring and said second leaf spring are zero.

15. The operation switch according to claim 13, wherein at least either one of said respective bent portions of said first leaf spring and said second leaf spring is formed of an arc-shaped portion that bulges outwardly from a corner of said general L-shape or a bend of said general U-shape.

16. The operation switch according to claim 13, wherein said respective bent portions of said first leaf spring and said second leaf spring are each formed of an arc-shaped portion that bulges outwardly from a corner of said general L-shape and a bend of said general U-shape, and a radius of curvature of said arc-shaped portion of said first leaf spring is different from a radius of curvature of said arc-shaped portion of said second leaf spring.

17. An operation switch comprising:

a switch case;

an operating member provided at said switch case; and a first contact and a second contact held in said switch case; wherein:

said first contact and said second contact are moved out of contact through operation of said operating member, an opening-biasing member is provided in said switch case, which opening-biasing member biases said first contact and said second contact away from each other out of contact, said opening-biasing member comprises a leaf spring having said first contact or said second contact thereon, either one of said first contact and said second contact is a fixed contact secured in said switch case and the other of said first contact and said second contact is a movable contact fitted at an end of said leaf spring and provided closable and openable relative to said fixed contact, said leaf spring comprises a first leaf spring of a general L-shape and a second leaf spring of a general U-shape, said first leaf spring has said movable contact at one end and a bent portion at an intermediate position between said one end and another end of said first leaf spring, and said second leaf spring has one end coupled to said movable contact at a position opposite said first leaf spring and a bent portion at an intermediate position between said one end and another end of said second leaf spring; and further comprising a contacting portion provided at a position corresponding to said other end of said second leaf spring in said switch case, wherein said contacting portion is adapted to come into contact with said second leaf spring to cause said movable contact to press-contact said fixed contact.

18. The operation switch according to claim 17, wherein said first leaf spring and said second leaf spring are adapted to be located at a position in which said movable contact is open relative to and away from said fixed contact when respective displacements of said first leaf spring and said second leaf spring are zero.

19. The operation switch according to claim 17, wherein at least either one of said respective bent portions of said first leaf spring and said second leaf spring is formed of an arc-shaped portion that bulges outwardly from a corner of said general L-shape or a bend of said general U-shape.

20. The operation switch according to claim 17, wherein said respective bent portions of said first leaf spring and said second leaf spring are each formed of an arc-shaped portion that bulges outwardly from a corner of said general L-shape and a bend of said general U-shape, and a radius of curvature of said arc-shaped portion of said first leaf spring is different from a radius of curvature of said arc-shaped portion of said second leaf spring.

* * * * *